US008584273B1

(12) United States Patent
Simoes et al.

(10) Patent No.: US 8,584,273 B1
(45) Date of Patent: Nov. 19, 2013

(54) PORTABLE LIFT CHAIR

(75) Inventors: Mario Alves Simoes, Pinellas Park, FL (US); Ryan Faris Smith, Lutz, FL (US); David James Demaree, Land O Lakes, FL (US); Arlin James Beechy, Sarasota, FL (US)

(73) Assignee: University of South Florida, Tampa, FL (US)

( * ) Notice: Subject to any disclaimer, the term of this patent is extended or adjusted under 35 U.S.C. 154(b) by 20 days.

(21) Appl. No.: 13/177,202

(22) Filed: Jul. 6, 2011

Related U.S. Application Data

(60) Provisional application No. 61/361,709, filed on Jul. 6, 2010.

(51) Int. Cl.
*A61G 7/10* (2006.01)

(52) U.S. Cl.
USPC ..... 5/83.1; 5/87.1; 5/81.1 RP; 5/81.1

(58) Field of Classification Search
USPC ..... 5/81.1 RP, 81.1 HS, 81.1 R, 83.1, 87.1, 5/662
See application file for complete search history.

(56) References Cited

U.S. PATENT DOCUMENTS 2,539,346 A * 1/1951 Feist ..... 5/86.1
2,962,730 A * 12/1960 Carnes et al. ..... 5/86.1
3,790,974 A * 2/1974 Johansson ..... 5/83.1
3,914,808 A * 10/1975 Woods ..... 5/83.1
3,940,808 A * 3/1976 Petrini ..... 5/83.1
4,157,593 A * 6/1979 Kristensson ..... 5/87.1
4,399,572 A * 8/1983 Johansson ..... 5/87.1
4,469,330 A * 9/1984 Asher ..... 463/38
4,704,749 A * 11/1987 Aubert ..... 5/87.1
4,719,655 A * 1/1988 Dean ..... 5/86.1
4,858,261 A * 8/1989 Iura ..... 5/87.1
5,265,689 A * 11/1993 Kauffmann ..... 180/65.51
5,507,044 A * 4/1996 Williamson et al. ..... 5/81.1 RP
5,524,303 A * 6/1996 Palmer et al. ..... 5/81.1 RP
5,524,304 A * 6/1996 Shutes ..... 5/81.1 R
5,560,053 A * 10/1996 Mills ..... 5/81.1 R
5,586,352 A * 12/1996 O'Brien et al. ..... 5/662
5,596,775 A 1/1997 DiMatteo et al.
5,819,338 A * 10/1998 Hession ..... 5/86.1
6,092,247 A * 7/2000 Wilson ..... 5/86.1
6,119,287 A * 9/2000 Phillips ..... 5/81.1 RP
6,427,270 B1 8/2002 Blevins et al.
6,430,761 B1 * 8/2002 Brandorff et al. ..... 5/86.1

(Continued)

*Primary Examiner* — Robert G Santos
*Assistant Examiner* — Myles Throop
(74) *Attorney, Agent, or Firm* — Nilay J. Choksi; Andriy Lytvyn; Smith & Hopen, P.A.

(57) ABSTRACT

A device for enabling a wheelchair user to enter and exit the wheelchair includes a stabilizing frame. The stabilizing frame has two slide rails to which a base plate is movingly attached. An electric motor drives a leadscrew, causing the base plate to move along the slide rails. A telescopic column is vertically mounted onto the base plate. The seat assembly, including handlebars and a seat platform, is rotationally attached to the top of the telescopic column. The telescopic column is extended and collapsed by a linear actuator, raising and lowering the seat assembly. A stationary non-rotational rod is vertically mounted onto the telescopic column. When a user sitting on the seat platform exerts a moment force on the stationary rod, the seat assembly rotates about the stationary rod. A locking mechanism prevents the seat assembly from rotating when the user is transferring to or from the seat platform.

18 Claims, 6 Drawing Sheets

(56) References Cited

U.S. PATENT DOCUMENTS

| | | | | |
|---|---|---|---|---|
| 6,557,188 | B1 * | 5/2003 | Peterson | 5/81.1 R |
| 6,711,759 | B1 * | 3/2004 | Kluckhuhn | 5/81.1 R |
| 6,941,595 | B1 * | 9/2005 | Michael | 5/83.1 |
| 7,086,103 | B2 * | 8/2006 | Barthelt | 5/613 |
| 7,647,655 | B2 * | 1/2010 | Liljedahl | 5/86.1 |
| 7,735,165 | B2 | 6/2010 | Stryker et al. | |
| 7,774,873 | B2 * | 8/2010 | Martin et al. | 5/81.1 R |
| 8,316,480 | B2 * | 11/2012 | Burak, Jr. et al. | 5/87.1 |
| 2004/0032395 | A1 * | 2/2004 | Goldenberg et al. | 345/156 |
| 2004/0129844 | A1 * | 7/2004 | Doyle | 248/188.8 |
| 2007/0067905 | A1 * | 3/2007 | Wilder | 5/83.1 |
| 2007/0258334 | A1 * | 11/2007 | Chiang et al. | 368/10 |
| 2009/0249544 | A1 * | 10/2009 | Palay et al. | 5/83.1 |
| 2010/0031439 | A1 * | 2/2010 | Spidare et al. | 5/87.1 |
| 2010/0154116 | A1 | 6/2010 | Fan | |
| 2010/0155560 | A1 * | 6/2010 | Makino | 248/346.01 |
| 2011/0289677 | A1 * | 12/2011 | Huang | 5/81.1 R |
| 2011/0289679 | A1 * | 12/2011 | Huang | 5/81.1 RP |
| 2012/0025050 | A1 * | 2/2012 | Ma | 248/346.01 |
| 2013/0117929 | A1 * | 5/2013 | Palay et al. | 5/87.1 |

* cited by examiner

PORTABLE LIFT CHAIR

CROSS REFERENCE TO RELATED APPLICATION

This application claims priority to currently pending U.S. provisional patent application No. 61/361,709, filed Jul. 6, 2010 by the same inventor and having the same title, which is hereby incorporated by reference.

BACKGROUND OF THE INVENTION

1. Field of the Invention

This invention relates to a portable device for assisting a wheelchair user to transfer from a wheelchair onto a bed and from a bed onto a wheelchair.

2. Description of the Related Art

The process of transferring an invalid person to and from a bed and a wheelchair often requires the help of two or more assistants. The task frequently requires considerable strength and is a common source of injury to the person being transferred or to an attendant doing the transfer or both. These transfer problems are often the major reason for requiring a patient to be hospitalized or moved to a nursing home, rather than being cared for at home, thereby increasing the cost of care. Moreover, invalid persons can easily be injured when they are being transferred between a bed and a wheelchair.

Most prior art teaching a device for transferring an invalid person between a wheelchair and a bed, such as U.S. Pat. Nos. 7,735,165 and 5,596,775, and most products currently available on the market require that an invalid person be assisted by third parties, such as licensed healthcare personnel. Services of such personnel may be very expensive and may also infringe on an invalid person's sense of independence and self worth. Furthermore, transfer devices currently available tend to be bulky and expensive, making them poorly suited for in-home or hotel use. The present invention is a new, useful, and nonobvious device that addresses the issues identified above that remained unsolved until now.

SUMMARY OF THE INVENTION

The primary objective of the present invention is to provide a portable device that enables a wheelchair user to transfer from a wheelchair and onto a bed surface. The device allows the user to accomplish such a transfer without any assistance from a third party, thus allowing wheelchair users to lead a more independent lifestyle. The present invention is portable and may be easily moved from one location to another. This feature makes the present invention especially ideal for hotels allowing them to place the novel transfer device in rooms of guests who use wheelchairs.

To achieve the above-mentioned objective the invention includes a portable chair transfer device having a seat platform that can move in a horizontal linear direction, in a vertical direction, and which can rotate three hundred sixty degrees (360°). The present invention includes a stabilizing frame functioning as a base. The stabilizing frame has two slide rails, to which a base plate is movingly attached. A leadscrew is rotationally attached to the stabilizing frame, and a leadscrew nut is screwthreadly engaged with the leadscrew. An electric motor drives the leadscrew, thus causing the base plate to move along the slide rails. A vertical telescopic column surmounts the base plate. The seat assembly, including handlebars and a seat platform, is rotationally attached to and surmounts the telescopic column. The telescopic column is extended and collapsed by an electric linear actuator. Extending the telescopic column raises the seat assembly, while collapsing the telescopic column lowers it. A stationary non-rotational rod is vertically mounted onto the top surface of the telescopic column. When a user sitting on the seat platform exerts a moment force on the stationary rod, the seat assembly rotates about the stationary rod. A locking mechanism prevents the seat assembly from rotating when the user is transferring to or from the seat platform. The user may use a control device to control the horizontal and vertical movement of the seat assembly.

It should be noted that the foregoing schematic description and the following detailed description of the present invention only exemplify the present invention, but do not limit the scope of the present invention.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

One embodiment of the claimed invention is depicted in FIGS. 1-10. The scope of the invention is not limited to that particular embodiment as several other embodiments are contemplated. Referring to FIGS. 1-4, the invention includes a stabilizing frame 20. Although the depicted stabilizing frame has a rectangular shape, other shapes also fall within the scope of the invention. For example, some embodiments may include oddly shaped stabilizing frames for aesthetic or functional reasons, such as allowing the device to fit in a confined space, etc.

Figure 1:
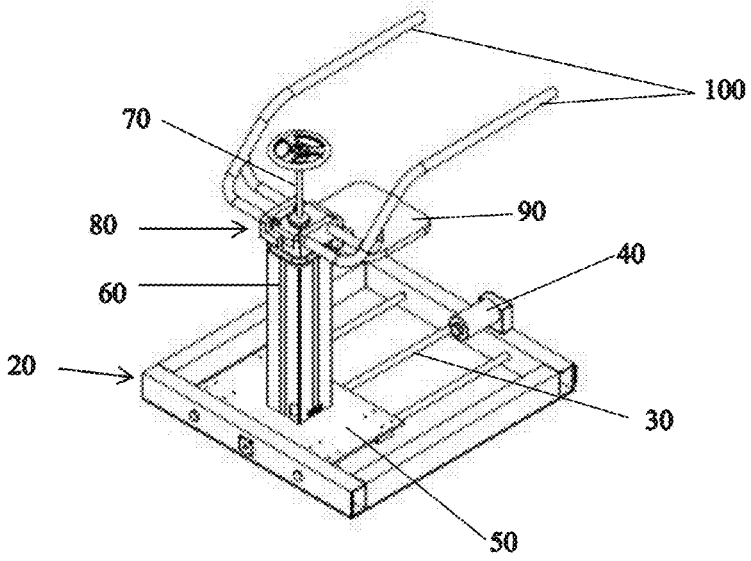
FIG. 1 is an isometric view of one embodiment of the invention.
Figure 2:
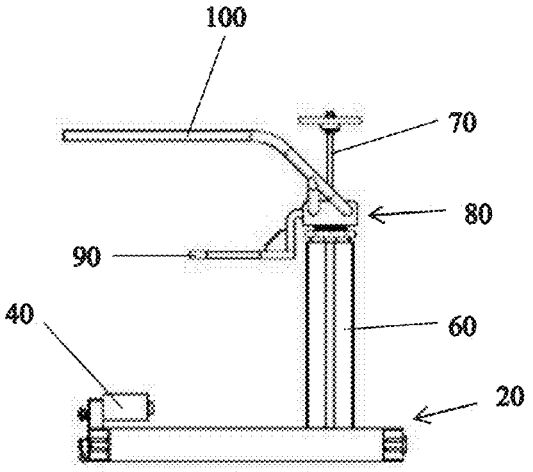
FIG. 2 is a side view of one embodiment of the invention.
Figure 3:
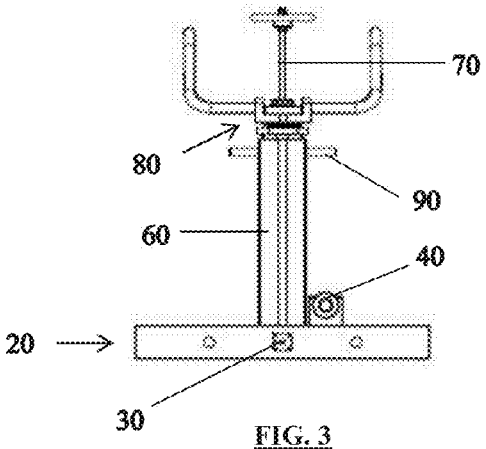
FIG. 3 is a front view of one embodiment of the invention.
Figure 4:
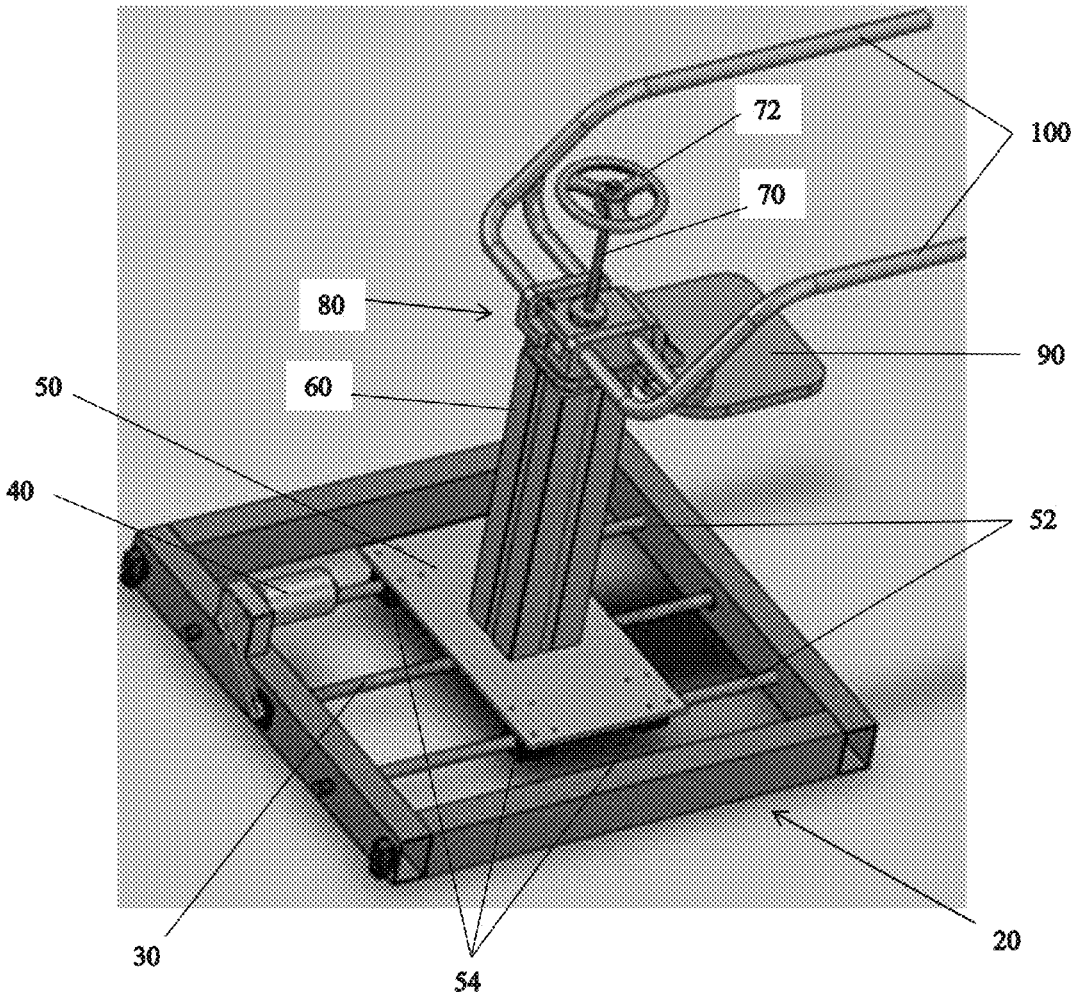
FIG. 4 is a perspective view of the invention.
Figure 5:
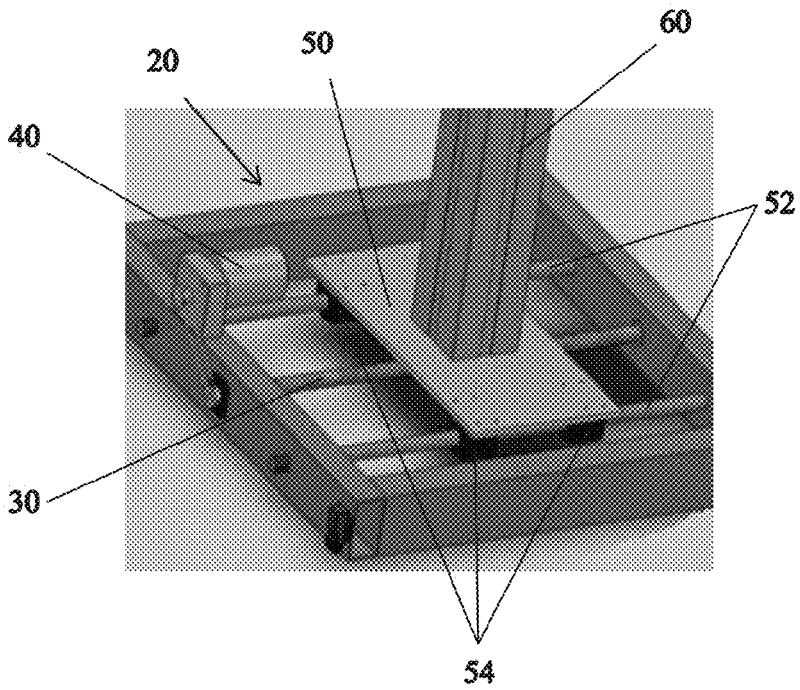
FIG. 5 is a perspective view of the upper portion of the stabilizing frame and the base plate connected thereto.
Figure 6:
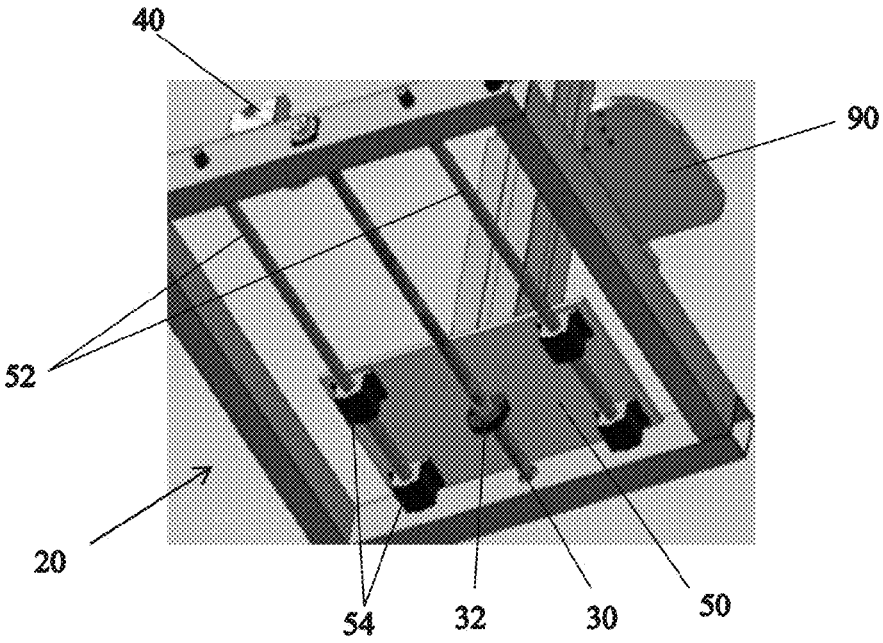
FIG. 6 is a perspective view of the bottom portion of the stabilizing frame and the base plate connected thereto.

FIGS. 5 and 6 depict how the elements of the invention interact with each other to allow for horizontal linear motion of the base plate 50, and thus, all the elements attached thereto. Leadscrew 30 is rotationally connected to stabilizing frame 20, thus allowing leadscrew 30 to rotate about its center axis while remaining in the same position. Two slide rails 52 are mounted to stabilizing frame 20: one slide rail 52 on each side of the leadscrew 30. Slide rails 52 perform the functions of supporting, stabilizing, and guiding base plate 50. Base plate 50 is connected to each slide rail 52 by two pillow block mounted linear bearings 54. Linear bearings 54 are mounted to the corners of the bottom surface of base plate 50 and are adapted to slide along slide rails 52.

Electric motor 40 is mounted to stabilizing frame 20. Electric motor 40 drives leadscrew 30, thus causing leadscrew 30 to rotate about its center axis. Leadscrew nut 32 is screwthreadly engaged with leadscrew 30, and its exterior surface is mounted to base plate 50. Since slide rails 52 allow the base plate to move only in a linear horizontal direction, the rotational motion of leadscrew 30 is translated into linear motion of leadscrew nut 32 and base plate 50 attached thereto.

The linear translational speed of base plate 50 (and thus of seat assembly 80 attached thereto) depends on characteristics of electric motor 40 and the amount of current and voltage supplied to it. The present invention requires that electric motor 40 outputs at least enough torque to drive leadscrew 30 when base plate 50 is loaded with the weight of the components attached to it, namely vertical member or telescopic column 60 and seat assembly 80, and the weight of a user occupying seat platform 90.

Figure 11:
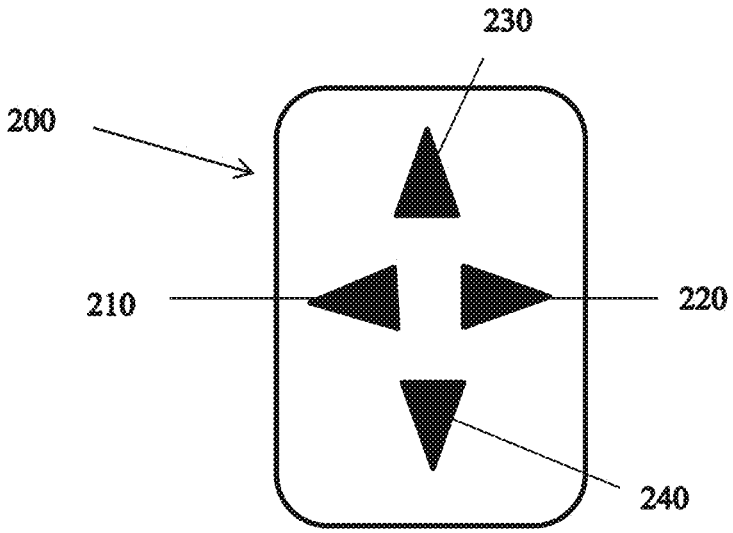
FIG. 11 is a top view of an embodiment of a control device.
Figure 12:
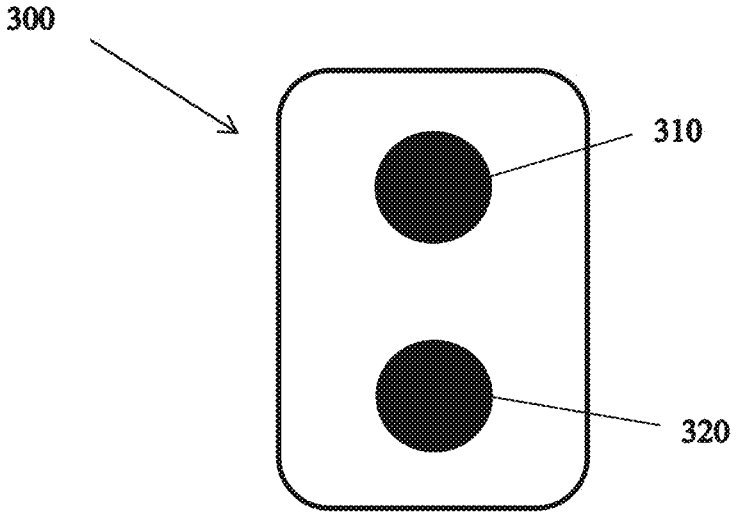
FIG. 12 is a top view of another embodiment of the control device.

The present invention discloses a way for the user to control the speed of horizontal movement by regulating the amount of current or voltage supplied to electric motor 40. The user of the present invention controls the operation of electric motor 40 via a control device, such as a wired or a wireless remote control (FIGS. 11 and 12). Although many embodiments of such control device fall within the scope of the present invention, one embodiment of the control device 200 includes two buttons 210 and 220 for controlling horizontal linear movement: button 220 for forward movement and button 210 for reverse movement. Therefore, with a push of a button, the user can horizontally move base plate 50 into a desired position.

Another embodiment of the control device 300 includes knob 310 for controlling horizontal linear movement: turning knob 310 clockwise results in movement of the base plate 50 in one direction, and turning knob 310 counterclockwise results in movement in the opposite direction. Furthermore, the amount of rotation of knob 310 controls the rotational speed of electric motor 40, and thus the linear speed of seat assembly 80.

Figure 7:
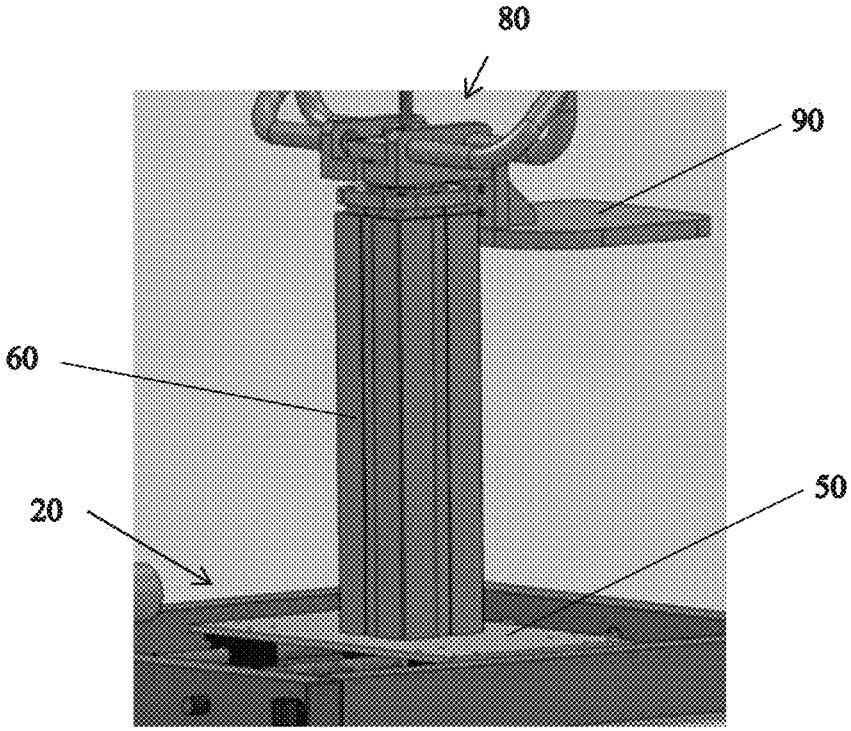
FIG. 7 is a perspective view of the telescopic column in a collapsed position and the seat assembly attached thereto.
Figure 8:
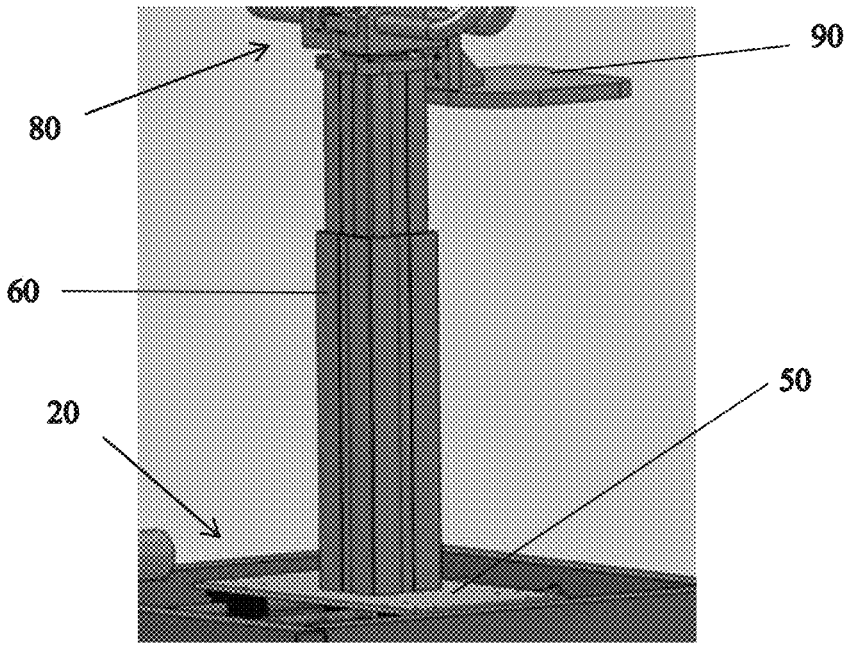
FIG. 8 is a perspective view of the telescopic column in an extended position and the seat assembly attached thereto.

FIGS. 7 and 8 depict telescopic column 60, which is vertically mounted to base plate 50. Seat assembly 80 is mounted to the top surface of telescopic column 60. An electric linear actuator (not depicted in the figures) extends and collapses telescopic column 60, thus raising and lowering seat assembly 80.

Ideally, the height of telescopic column 60 in a collapsed configuration (FIG. 7) is such that seat platform 90 is aligned with the seat surface of a standard wheelchair. The minimum height of telescopic column 60 in a fully extended configuration must be such that seat platform 90 is aligned with the surface of the user's bed.

The speed with which the seat assembly is raised and lowered is determined by the characteristics of the electric linear actuator and the amount of current and voltage supplied to it. The linear actuator must be capable of controllably extending and collapsing telescopic column 60 when seat platform 90 is loaded with the weight of the user.

The user controls the electric linear actuator via a control device, such as a wired or a wireless remote control (FIGS. 11 and 12). Although many embodiments of such control device fall within the scope of the present invention, one embodiment of control device 200 includes two buttons 230 and 240 for control of vertical movement, button 230 for upward movement and button 240 for downward. Therefore, with a push of a button, the user can vertically move seat assembly 80 into a desired position.

Another embodiment of control device 300 includes knob 320: for example, turning knob 320 clockwise results in electric linear actuator extending telescopic column 60, thus raising seat assembly 80, while turning knob 320 counterclockwise results in collapsing or retracting telescopic column 60, thus lowering seat assembly 80. Furthermore, the amount of rotation of the knob controls the speed with which the electric linear actuator extends and collapses telescopic column 60, therefore giving the user complete control over the speed of vertical movement. Preferably, controls for both electric motor 40 and the electric linear actuator are located on the same control device for the user's convenience.

Figure 9:
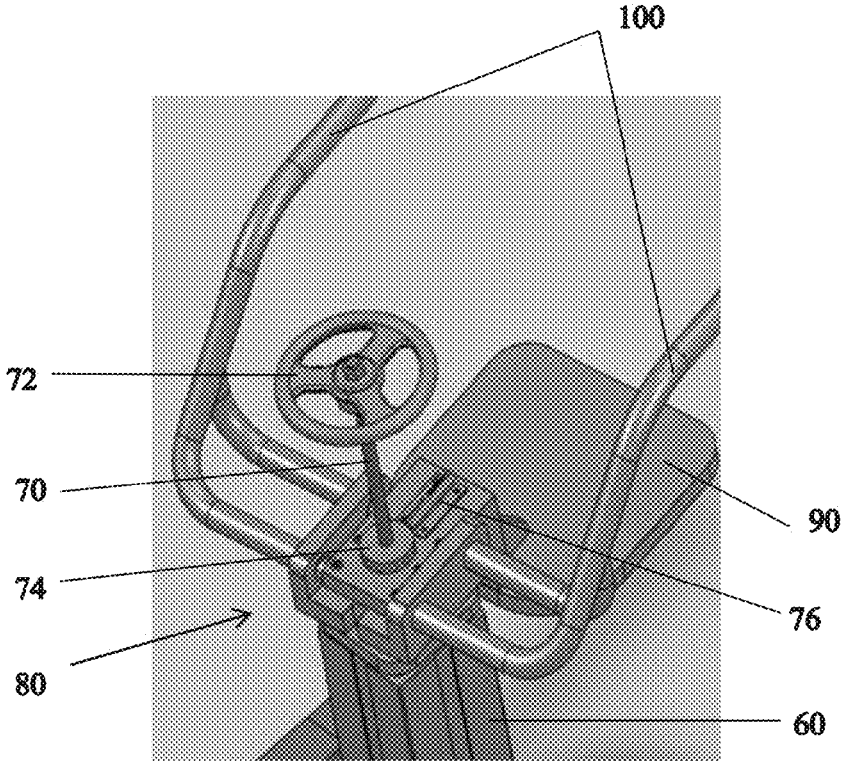
FIG. 9 is a perspective view of the seat assembly rotationally attached to the telescopic column and the stationary rod with a handle affixed to the telescopic column.
Figure 10:
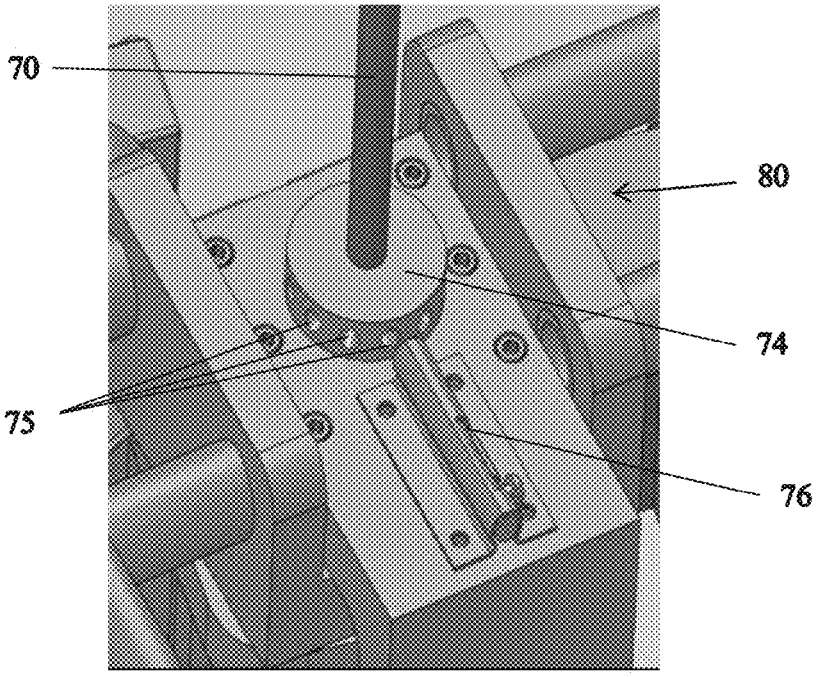
FIG. 10 is a perspective view of an embodiment of a locking mechanism.

FIGS. 9 and 10 depict two handlebars 100 attached to seat platform 90, thus forming seat assembly 80. The handlebars serve a function of assisting the user with supporting the user's body while transferring from and to seat platform 90.

Seat assembly 80 is attached to the top surface of telescopic column 60 via a central thrust bearing, thus allowing for a smooth rotation and reducing the amount of moment force required to rotate seat assembly 80 about a vertical axis. Seat assembly 80 has a 360° rotational freedom, thus allowing the user to move to any position within a 360° field.

FIGS. 9 and 10 further depict stationary rod 70 perpendicularly mounted to the top surface of telescopic column 80. Stationary rod 70 is non-rotating. For the user's convenience, non-rotating handle 72 may be attached to stationary rod 70. While seating on seat platform 90, the user can rotate seat assembly 80 by exerting a moment force on non-rotating handle 72. Non-rotating handle 72 may be raised or lowered to adjust to the preferences of the user. The angular speed and the degree of rotation are both controlled by the amount of moment force the user exerts on the non-rotating handle. Therefore, the user is in complete control of the rotation of seat assembly 80.

FIG. 10 depicts a locking mechanism 78. This embodiment of the locking mechanism includes two parts: locking disc 74 which is non-rotationally mounted to stationary rod 70 and barrel bolt 76 mounted onto seat assembly 80. On its side surface, locking disc 74 contains evenly spaced predrilled holes 75 adapted to receive barrel bolt 76. The user rotates seat assembly 80 into a desired position, and once the desired position is achieved the user can slide barrel bolt 76 into predrilled hole 75 corresponding to that position to prevent further rotation of seat assembly 80. Locking mechanism 78 is a safety feature that keeps the seat assembly steady while the user transfers from and to seat platform 90.

The present invention is not limited to the embodiment depicted in FIGS. 1-10. The scope of the present invention encompasses variations of the features shown in FIGS. 1-10, and although such variations are too numerous to list, some of the most important variations are disclosed as follows.

In the embodiment disclosed above, the horizontal linear movement of seat assembly 80 is accomplished by leadscrew 30 driven by electric motor 40. However, there are a number of means commonly known in the art that can perform the same function. Some of those means include the following: an electric linear actuator, a hydraulic mechanism, a motorized linear guide rail, and an electric motor driving a loop belt, surface of which is attached to base plate 50.

In the first disclosed embodiment the vertical movement of seat assembly 80 is accomplished by telescopic column 60 and an electric linear actuator. However, the vertical movement may be accomplished by other means commonly known in the art, such as a hydraulic mechanism, a vertical gear rod engaged by a gear motor attached to seat assembly 80, or a vertical member and a pulley belt system driven by an electric motor.

The rotation of seat assembly 80 may be accomplished by using an electric motor which drives the seat assembly in such a way, that operating of that electric motor causes the seat assembly to rotate. The controls for that motor may be placed on the same control device 200 or 300 as controls for horizontal and vertical movement, so that the user can completely control the motion of seat assembly 80 from one control device.

Locking mechanism 78 depicted in FIGS. 9 and 10 may be replaced by a friction brake that would be mounted onto the seat assembly and exert force on stationary rod 70 to prevent seat assembly 80 from rotating when the user is transferring to and from seat platform 90.

Seat assembly 80, as disclosed above and depicted in FIGS. 1-10 includes seat platform 90 and two handlebars 100. An alternative embodiment of the invention may include only one handlebar, or more than two handlebars. An alternative embodiment may also include a foot support bar to help the user balance the user's lower body while seated on seat platform 90.

The control device disclosed above is a wired or a wireless remote control. However, if voice or motion recognition technology becomes commercially feasible, the present invention is capable of integrating such technology, thus allowing the user to control the portable transfer chair with voice commands or gestures.

Furthermore, gear systems may be used in conjunction with various electric motors to adjust the speed of horizontal, vertical, or rotational movement of seat assembly 80.

The present invention may also incorporate sensors for aligning seat platform 90 with surfaces of the wheelchair seat and the bed to make the invention suitable for blind wheelchair users.

What is claimed is:

1. A portable lift chair device comprising:

a stabilizing frame having a top edge and inner boundaries, said stabilizing frame defining an empty space within said inner boundaries of said stabilizing frame;

one or more parallel, spaced slide rails disposed within said empty space and fixedly connecting two opposing sides of said stabilizing frame;

a base plate connected to each slide rail of said one or more slide rails, said base plate having dimensions that are smaller than the dimensions of said stabilizing frame, said base plate having a bottom edge that is set below said top edge of said stabilizing frame;

a vertical member mounted on said base plate;

a seat assembly attached to and disposed in overlying relation to said vertical member, whereby said one or more slide rails allows said seat assembly to move in a controlled, horizontal linear direction while said stabilizing frame and said one or more slide rails remain stationary;

said seat assembly including a substantially planar seating platform that extends in substantially perpendicular relation to said vertical member;

at least one handlebar attached to said seat assembly;

a vertical control means allowing a user to cause raising and lowering of said seat assembly; and a rotation means allowing said user to rotate said seat assembly about a vertical axis, wherein said base plate does not rotate with said seat assembly.

2. The portable lift chair according to claim 1, further comprising:

said vertical member being a telescopic column capable of raising and lowering said seat assembly when said seat assembly is occupied by said user.

3. The portable lift chair according to claim 2, further comprising:

said vertical control means including an electric linear actuator engaging said telescopic column; and a control mechanism allowing said user to control operation of said electric linear actuator to raise and lower said user's body to a preselected elevation.

4. The portable lift chair according to claim 3, further comprising:

said control mechanism including a control device having a first button causing said seat assembly to be raised and a second button causing said seat assembly to be lowered.

5. The portable lift chair according to claim 3, further comprising:

said control mechanism including a turning knob, wherein amount of rotation of said turning knob controls speed of vertical movement of said seat assembly, and angular direction of rotation of said turning knob controls direction of vertical movement of said seat assembly.

6. The portable lift chair according to claim 1, further comprising:

said stabilizing frame having at least a front member and a back member; and said vertical member being movably mounted in upstanding relation to said stabilizing frame.

7. The portable lift chair according to claim 6, further comprising:

said one or more slide rails including a motorized leadscrew attached to said stabilizing frame in parallel spaced relation to said one or more slide rails, said base plate further connected to said leadscrew, wherein operation of said motorized leadscrew causes said base plate and said vertical member attached thereto to move in a linear horizontal direction, thus resulting in horizontal linear movement of said seat assembly attached to said vertical member.

8. The portable lift chair according to claim 6, further comprising:

an electric linear actuator coupled to and in communication with said vertical member;

wherein operation of said electric linear actuator causes said vertical member and said seat assembly attached thereto to move in a linear horizontal direction.

9. The portable lift chair according to claim 6, further comprising:

an electric motor mounted to said stabilizing frame having an output shaft disposed in engaging relation to a loop belt;

said loop belt having a top surface and a bottom surface, said loop belt being rotationally stretched between said front member and said back member of said stabilizing frame, said top surface of said loop belt being affixed to said bottom surface of said vertical member, wherein operating said electric motor causes said loop belt to rotate, thus resulting in linear horizontal movement of said vertical member, thus resulting in horizontal movement of said seat assembly attached to said vertical member.

10. The portable lift chair according to claim 6, further comprising:

said one or more slide rails including a leadscrew assembly rotationally attached to said stabilizing frame:

said leadscrew assembly including a leadscrew having a leading end and a trailing end;

said leading end rotationally attached to said front member of said stabilizing frame;

said trailing end rotationally attached to said back member of said stabilizing frame;

a leadscrew nut in in screwthreaded engagement with said leadscrew;

said vertical member disposed in surmounting relation to said leadscrew nut;

an electric motor mounted to said stabilizing frame;

said electric motor disposed in driving relation to said leadscrew, so that said leadscrew nut and said seat assembly are displaced in a linear direction by operation of said electric motor; and a motor control means allowing said user to control operation of said electric motor to move said seat assembly to a preselected position of horizontal adjustment.

11. The portable lift chair according to claim 1, further comprising:

said seat assembly being disposed in surmounting relation to said vertical member and being rotatable about a vertical axis of said vertical member;

a stationary, non-rotating rod mounted in surmounting relation to said vertical member; and a handle attached to said stationary rod, so that said user seated on said seating platform can cause said seat assembly to rotate about said stationary rod by applying a moment force to said handle.

12. The portable lift chair according to claim 11, further comprising:

a locking mechanism attached to said seat assembly to allow said user to lock said seat assembly in a preselected rotational position to prevent said seat assembly from rotating during transfer from and to said seating platform.

13. The portable lift chair according to claim 12, further comprising:

said locking mechanism including a plurality of holes formed in said stationary rod, each of which is adapted to receive a barrel bolt attached to said seat assembly.

14. The portable lift chair according to claim 12, further comprising:

said locking mechanism including a friction brake attached to said seat assembly for applying a force to said stationary rod, creating friction between said friction brake and said stationary rod to inhibit rotation of said seat assembly.

15. The portable lift chair according to claim 1, further comprising:

said seat assembly mounted in surmounting relation to said vertical member and being rotatable about a vertical axis of said vertical member;

an electric motor disposed in driving relation to said seat assembly so that said seat assembly rotates relative to said vertical member and said stabilizing frame when driven by said electric motor; and a motor control means for controlling operation of said electric motor.

16. The portable lift chair according to claim 1, further comprising:

a foot support attached to said seating platform so that said user can place said user's feet on said foot support while seated on said seat platform.

17. A portable lift chair comprising:

a quadrilateral stabilizing frame having a front member, a back member, two side members, a top edge, and inner boundaries, said stabilizing frame defining an empty space within said inner boundaries of said stabilizing frame;

a plurality of parallel, spaced slide rails disposed within said empty space and fixedly connecting two opposing sides of said quadrilateral stabilizing frame, said plurality of slide rails;

a base plate connected to each slide rail of said one or more slide rails, said base plate having dimensions that are smaller than the dimensions of said stabilizing frame, said base plate having a bottom edge that is set below said top edge of said stabilizing frame;

a leadscrew assembly including a leadscrew and a leadscrew nut;

said leadscrew having a front end, a back end, and a center axis, said front end of said leadscrew being rotationally attached to said front member of said stabilizing frame;

said back end of said leadscrew being rotationally attached to said back member of said stabilizing frame;

an electric motor attached to said stabilizing frame;

said electric motor disposed in driving relation to said leadscrew so that said leadscrew nut is driven along said center axis of said leadscrew by said electric motor;

a base plate being movably attached to said stabilizing frame, said base plate being mounted for linear movement between said front member of said stabilizing frame and said back member of said stabilizing frame, said base plate having dimensions that are smaller than the dimensions of said stabilizing frame;

said base plate being mounted in surmounting relation to said leadscrew nut so that said base plate is driven linearly along said center axis of said leadscrew by said electric motor;

a telescopic column mounted in surmounting relation to said base plate;

a seat assembly mounted in surmounting relation to said telescopic column, whereby said leadscrew assembly and said plurality of slide rails allows said seat assembly to move in a controlled, horizontal linear direction while said stabilizing frame, said leadscrew assembly, and said plurality of slide rails remain stationary;

said seat assembly being mounted for rotation about a vertical axis of said telescopic column;

said seat assembly including a substantially planar seat platform adapted to support a user and extending in substantially perpendicular relation to said vertical member;

at least one handlebar attached to said seat assembly;

said seat assembly including a stationary, vertically disposed rod so that said seat assembly rotates when said user exerts a moment on said stationary rod, wherein said base plate does not rotate with said seat assembly;

a locking mechanism attached to said seat assembly to allow said user to lock said seat assembly in a preselected rotational position to prevent said seat assembly from rotating during transfer from and to said seating platform, said locking mechanism including a plurality of holes formed in said stationary rod, each of which is adapted to receive a barrel bolt attached to said seat assembly; and a control mechanism for controlling the horizontal and vertical movement of said seat assembly.

18. A method for operating a portable lift chair, comprising the steps of:

providing a seat assembly and a base plate coupled to one another by a vertical column, said seat assembly including a seating platform extending in perpendicular relation to said vertical column, said base plate positioned on one or more fixed slide rails disposed within a stabilizing frame, whereby said slide rails facilitate horizontal linear movement of said seat assembly, said vertical column, and said base plate while said stabilizing frame and said one or more slide rails remain stationary, said base plate having a bottom edge that is set below a top edge of said stabilizing frame;

positioning an occupied wheelchair next to said portable lift chair;

coupling handlebars to said seat assembly for rotating said seat assembly so that said seating platform of said portable lift chair is aligned with a seat of said wheelchair;

electrically displacing said vertical column along said one or more slide rails, thereby horizontally displacing said seat assembly away from said wheelchair and toward said bed after a user has used said handlebars to move from said wheelchair seat to said seat of said portable lift chair;

vertically adjusting said seat of said portable lift chair until it is aligned with a support surface of said bed;

rotatably adjusting said seat of said portable lift chair until it makes contact with said support surface, wherein said base plate does not rotate with said seat;

whereby said handlebars enable a user to move from said seat of said portable lift chair device onto said support surface.

* * * * *